US006299931B1

(12) United States Patent
Leary et al.

(10) Patent No.: US 6,299,931 B1
(45) Date of Patent: Oct. 9, 2001

(54) SYSTEM AND METHOD FOR SETTING, REGULATING AND MONITORING AN APPLICATOR

(75) Inventors: Kevin C. Leary, Orland Park; Kenneth W. Santefort, Mokena, both of IL (US); Carl J. Joerger, St. Louis, MO (US)

(73) Assignee: W. H. Leary Co., Inc., Mokena, IL (US)

( * ) Notice: Subject to any disclaimer, the term of this patent is extended or adjusted under 35 U.S.C. 154(b) by 0 days.

(21) Appl. No.: 09/289,425

(22) Filed: Apr. 9, 1999

(51) Int. Cl.[7] ..... B05D 7/24

(52) U.S. Cl. ..... 427/8; 118/676; 118/703; 118/712; 118/713; 118/686; 118/687

(58) Field of Search ..... 427/8; 118/676, 118/703, 689, 686, 679, 687, 712, 713; 198/339.1, 340, 341.01, 341.04, 341.05; 700/108, 112; 156/64, 362, 363, 356, 367

(56) References Cited

U.S. PATENT DOCUMENTS

| | | | | |
|---|---|---|---|---|
| 4,172,347 | | 10/1979 | Nitz . | |
| 4,647,208 | | 3/1987 | Bieman . | |
| 4,704,603 | | 11/1987 | Edwards et al. . | |
| 4,778,999 | | 10/1988 | Fisher . | |
| 5,375,722 | | 12/1994 | Leary et al. . | |
| 5,479,352 | | 12/1995 | Smith . | |
| 5,683,752 | * | 11/1997 | Popp et al. | 427/421 |
| 5,732,147 | | 3/1998 | Tao . | |
| 5,807,449 | * | 9/1998 | Hooker et al. | 156/64 |
| 5,876,502 | * | 3/1999 | Sugimura et al. | 118/712 |

* cited by examiner

*Primary Examiner*—Laura Edwards
(74) *Attorney, Agent, or Firm*—Wood, Phillips, VanSanten, Clark & Mortimer

(57) ABSTRACT

A system and method for setting up an applicator to treat a target blank traveling on a conveyor includes placing a mark on an example blank, where the mark represents a desired location for treatment of the target blank. The marked example blank is passed along the conveyor, and the location of the mark is sensed on the example blank. The applicator is programmed to treat the target blank at the sensed location. Further, a method and system for regulating an applicator for treating a desired location of a target blank traveling along a conveyor include passing the target blank along the conveyor and sensing an applied location of the treatment to the target blank. The applied location is compared with the desired location and responsive to the comparing, the applicator is adjusted to apply the treatment closer to the desired location. In addition, a method and system for determining a delay of an applicator for treating a desired location of a target blank traveling along a conveyor includes passing the target blank along the conveyor, and applying a treatment to the target blank. An applied location of the treatment is sensed, and a distance between the applied location and the desired location is determined.

26 Claims, 8 Drawing Sheets

SYSTEM AND METHOD FOR SETTING, REGULATING AND MONITORING AN APPLICATOR

FIELD OF THE INVENTION

The present invention is directed to an applicator for blanks moving on a conveyor, and in particular, a system and method for setting up, regulating and monitoring such an applicator.

BACKGROUND OF THE INVENTION

Blanks, or work pieces, are treated while moving on a conveyor past an applicator. For example, glue is applied to a carton blank as it moves on a conveyor passed a glue applicator.

To set the applicator to apply the treatment at the desired location, an operator measures the desired location and sets the applicator. This procedure has potential for error, as the operator may incorrectly measure the desired location, or incorrectly set the applicator.

Further, once set, the applicator may apply the treatment in a location other than the desired location due to changes in operating conditions. For example, where the applicator is a glue applicator, glue valve delay, or changes in glue pressure or consistency may cause the glue to be applied to the blank at a location other than the desired location. The operator must measure the applied location of the treatment, and reset the applicator until the applied location matches the desired location. This is a time consuming process as it requires several repetitions, thereby reducing productivity.

Additionally, operation of the applicator results in wear, necessitating that parts of the applicator be replaced. For example, where the applicator is ,a glue applicator including a glue valve, operation of the glue applicator causes wear to the glue applicator valve. To sense applicator component wear, the operator monitors the applicator by observing an applied location of the treatment. A difference between the applied location and the desired location greater than a predetermined value indicates the worn components, necessitating replacement of the worn components. Due to error in the operator's observations, applicator components are often not replaced at the correct time.

SUMMARY OF THE INVENTION

An example blank is marked at a desired location for treatment of a target blank, and the marked example blank is passed along the conveyor. The mark is sensed, and the applicator is set to treat the target blank at the sensed location.

During treatment of the target blank, an applied location of the treatment is sensed. As the applied location deviates from the desired location, the applicator is adjusted to apply the treatment at the desired location.

A delay is determined between the time the applicator is directed to apply the treatment and the time the treatment is actually applied, where the delay is displayed on a display device. The delay aids the operator in monitoring the applicator as a more accurate determination of applicator component wear is provided.

More specifically, a system and method for setting up an applicator to treat a target blank traveling on a conveyer includes placing a mark on the example blank, where the mark represents a desired location for treatment of the target blank. The marked example blank is passed along the conveyor. The location of the mark on the example blank is sensed, and the applicator is programmed to treat the target blank at the sensed location.

In one aspect, the example blank has a reference point, and the mark is defined by a beginning of the mark, and the step of sensing the location of the mark includes detecting the reference point on the example blank traveling along the conveyor and detecting the beginning of the mark on the example blank. A start distance is determined between the reference point and the beginning of the mark. Further, the step of programming the applicator includes setting the applicator to begin treatment of the target blank at the start distance.

In another aspect, the example blank has a reference point, the mark is defined by an end of the mark, and the step of determining the location of the mark includes detecting the reference point on the example blank traveling along the conveyor, and detecting the end of the mark on the example blank. An end distance is determined between the reference point and the end of the mark. Further, the step of programming the applicator includes setting the applicator to stop treatment of the target blank at the end distance.

Additionally, the applicator may, for example, apply glue to or cut a slit or opening in the target blank.

A method and system for regulating an applicator for treating a desired location of a target blank traveling along a conveyor includes passing the target blank along the conveyor and sensing an applied location of the treatment to the target blank. The applied location is compared with the desired location and the applicator is adjusted to apply the treatment at the desired location.

In one feature, the applied location is defined by a beginning of the treatment and the target blank has a reference point, and the step of sensing the applied location includes detecting the reference point on the target blank traveling along the conveyor. The beginning of the treatment is detected on the target blank, and a begin treatment distance is determined between the reference point and the beginning of the treatment. Further, where the desired location is defined by a desired start distance, the step of adjusting the applicator includes decreasing the begin treatment distance if the desired start distance is less than the begin treatment distance, and increasing the begin treatment distance if the begin treatment distance is less than the desired start distance.

In a further feature, where the applied location is defined by an end of the treatment and the target blank has a reference point, sensing the applied location includes detecting the reference point on the target blank traveling along the conveyor and detecting the end of the treatment on the target blank. An end treatment distance between the reference point and the end of the treatment is determined. Further, where the desired location is defined by a desired end distance, the step of adjusting the applicator includes decreasing the end treatment distance if the desired end distance is less than the end treatment distance, and increasing the end treatment distance if the end treatment distance is less than the desired end distance.

It is an additional feature that the step of adjusting the applicator includes adjusting the applicator to apply a substance on the target blank.

In an additional feature, where the applicator treats a plurality of target blanks, the applied locations of treatment for a plurality of target blanks are determined, and an average applied location is determined. The step of comparing compares the average applied location with the desired location.

A system and method for determining a delay of an applicator for treating a desired location of a target blank traveling along a conveyor is provided, where the target blank is passed along the conveyor, and a treatment is applied to the target blank. The applied location of the treatment is sensed, and a distance representing applicator delay is determined between the applied location and the desired location.

In one aspect, a conveyor speed is sensed, and the distance is divided by the conveyor speed.

In another aspect, the distance between the applied location and the desired location is displayed on a display device.

DETAILED DESCRIPTION OF THE INVENTION

Figure 1A:
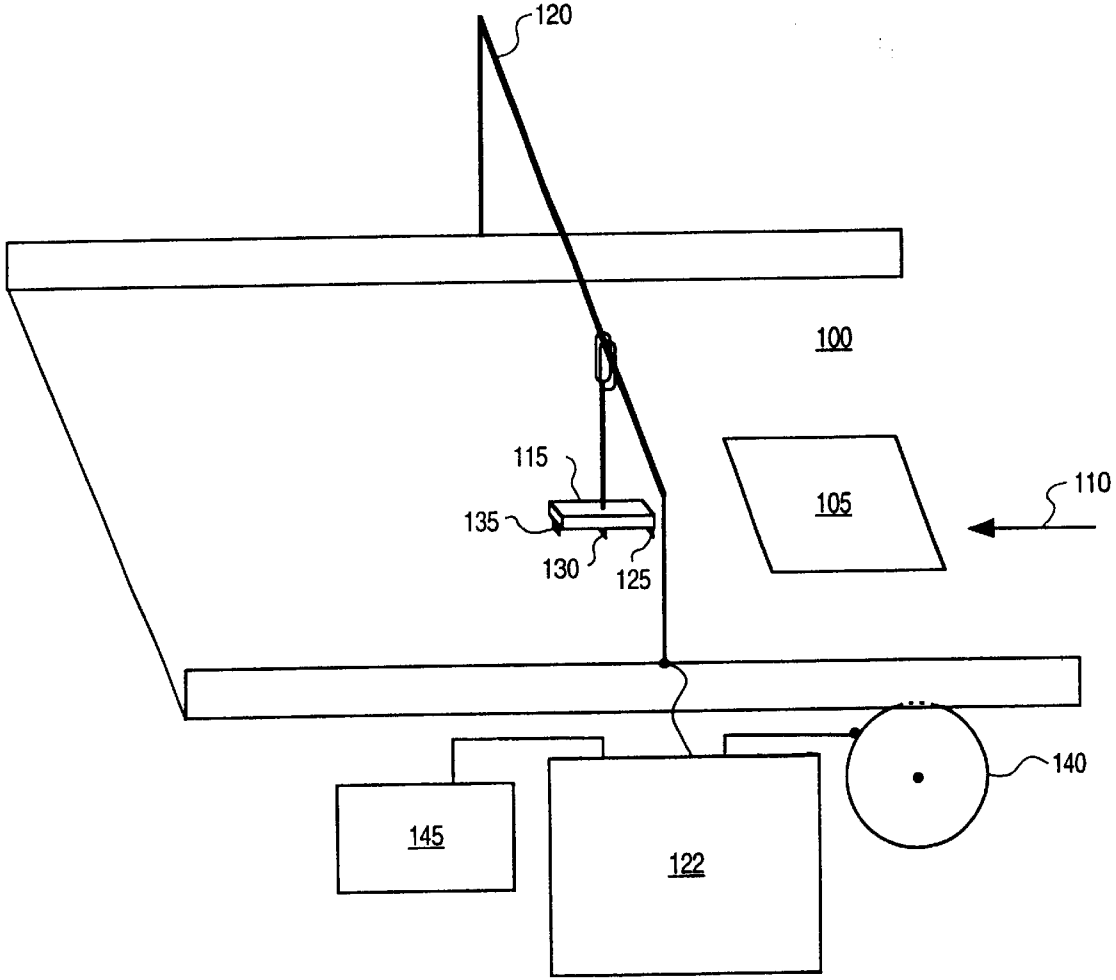
FIG. 1A is a perspective view of the system for setting up, regulating and monitoring the applicator.
Figure 1B:
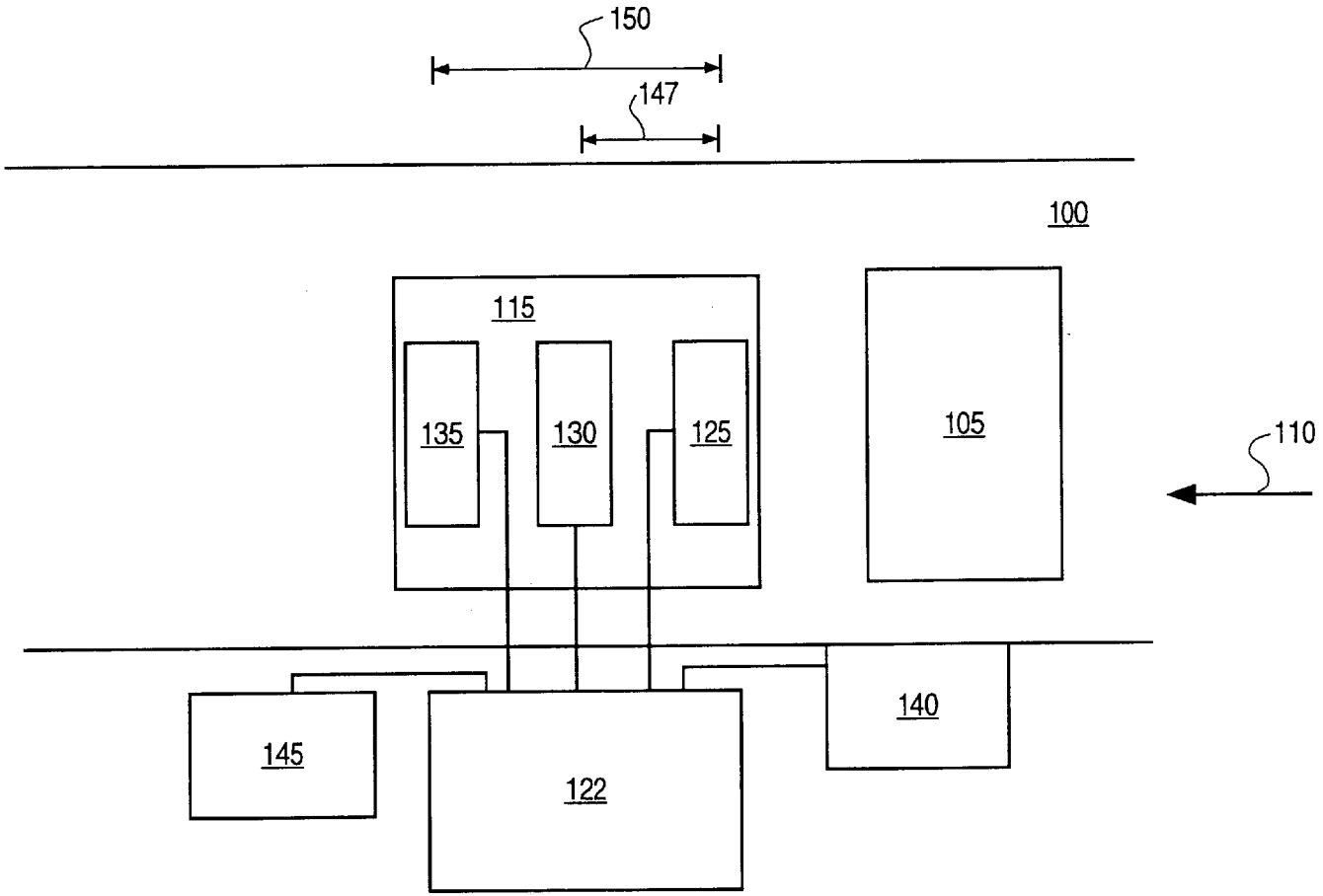
FIG. 1B is a block diagram of a system for setting up, regulating and monitoring the applicator.
Figure 2A:
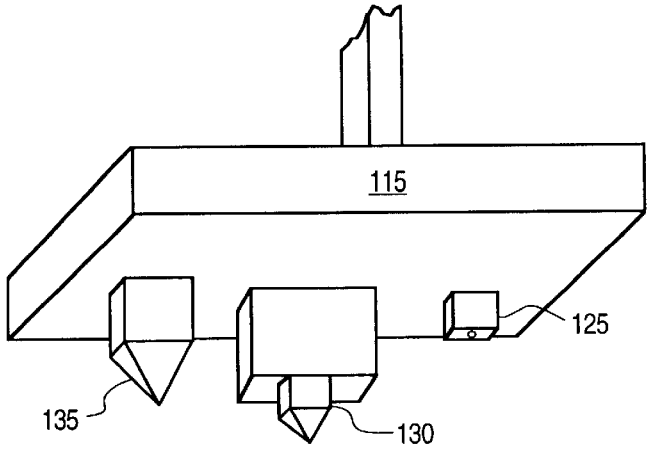
FIG. 2A is a perspective view of the applicator.
Figure 2B:
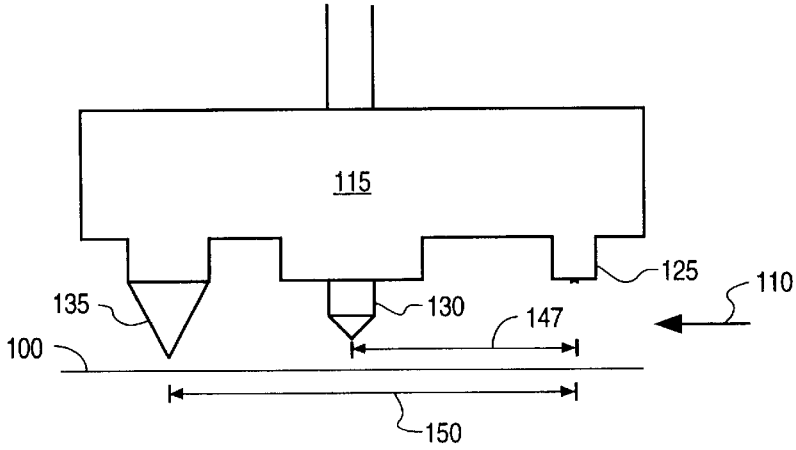
FIG. 2B is a side elevation view of the applicator.
Figure 3:
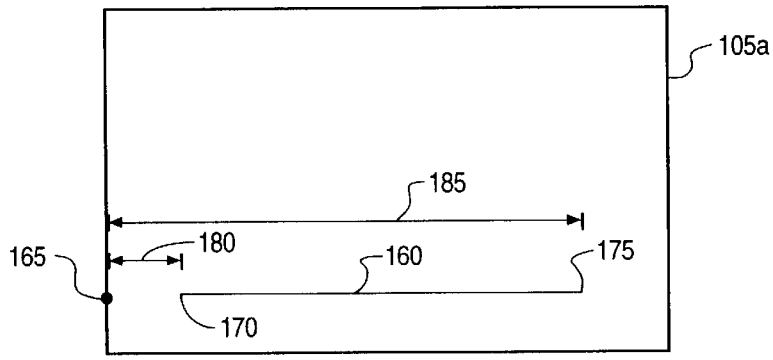
FIG. 3 is a plan view of the example blank.

A system for setting up an applicator is shown in FIGS. 1A–B and 2A–B. The system includes a conveyor 100 on which a blank 105 travels in the direction indicated by an arrow 110. An applicator assembly 115 is suspended over the conveyor 100 by a support bar 120. The applicator assembly 115 includes a reference sensor 125 for sensing a reference point on the blank, an applicator 130 for applying a treatment to the blank, and a sensor 135 for sensing an applied location of the treatment to the blank. A controller 125 is coupled to and controls each of the reference sensor 125, the applicator 130 and the sensor 135. The controller 122 is further coupled to a conveyor encoder 140, where the conveyor encoder 140 is responsive to the conveyor 100. A display device 145 is coupled to the controller 122 for displaying system information, such as the desired location and applicator delay. A distance 147 is the distance between the reference sensor 125 and the applicator 130. A distance 150 is the distance between the reference sensor 125 and the sensor 135.

Where the system is being set up, the blank 105 is an example blank 105*a*, shown in FIG. 3. Where the system is regulating or monitoring the applicator, the blank 105 is a target blank 105*b*, shown in FIG. 6.

Before describing operation of the system for setting up, adjusting and monitoring an applicator, a discussion of how the applicator 130 applies the treatment to the example blank 105*a*, will be helpful.

The controller 122 sets the applicator 130 to apply the treatment to the blank 105 at a desired location defined by a desired start distance and a desired end distance. The reference sensor 125 detects a reference point of the blank 105*a*, typically a leading edge of the blank. The controller 122, using the conveyor encoder 140, causes the applicator 130 to begin treatment after the blank 105 has traveled the desired start distance plus the distance 147. The controller 122 causes the applicator 130 to end treatment of the blank 105 after the blank 105 has traveled the desired end distance plus the distance 147.

Figure 4:
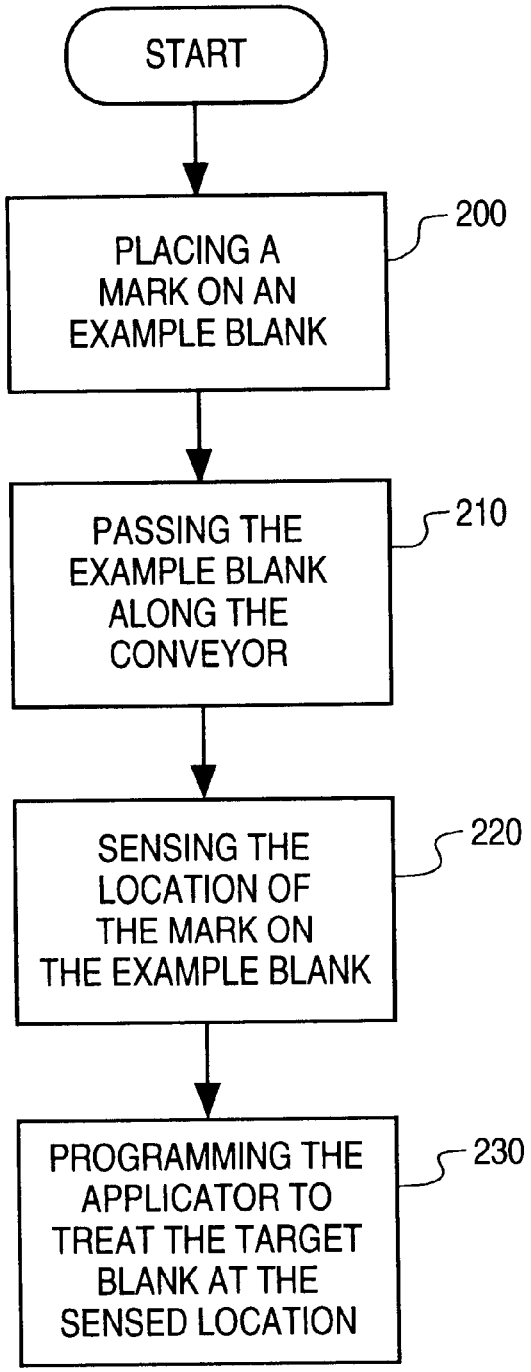
FIGS. 4–5 are flow charts illustrating operation of the system for setting up the applicator.
Figure 5:
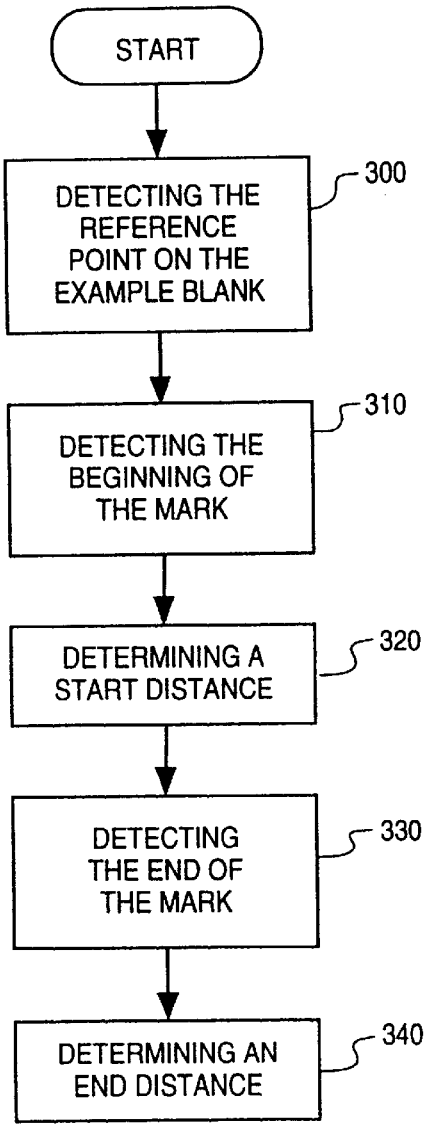

Operation of the system for setting up the applicator is shown in the flow charts of FIGS. 4–5.

The system operator places a mark 160 on the example blank 105*a*, defined by a beginning of the mark 170 and an end of the mark 175, the mark 160 representing the desired location at which the applicator 130 is to treat a target blank traveling on the conveyor 100.

The example blank 105*a* is placed on the conveyor 100, and the applicator assembly 115 is adjusted along the support bar 120 such that the reference sensor 125, the applicator 130 and the sensor 135 align with the mark 160 as the example blank 105*a* passes along the conveyor 100 in the direction 110, block 210. As the example blank 105*a* passes under the applicator apparatus 115, the location of the mark 160 is sensed as shown in block 220. The applicator 130 is programmed to treat the target blank at the sensed location, block 230, further discussed below. A more detailed flow chart illustrating the sensing of block 220 is shown in FIG. 5.

The reference point 165 of example blank 105*a* is sensed by the reference sensor 125 as shown in block 300 of FIG. 5. The controller 122 begins taking a distance measurement using the conveyor encoder 140 as the example blank 105*a* passes under the applicator apparatus 115. The beginning of the mark 170 is detected by the sensor 135, at which time the controller 122 records a first distance measurement of conveyor encoder 140 and determines a start distance 180 by subtracting the distance 150 from the first distance measurement, block 320. The controller 122 continues to measure distance using the conveyor encoder 140. The sensor 135 detects the end of the mark 175, block 330, and the controller 122 records a second distance measurement, and determines an end distance 185 by subtracting the distance 150 from the second distance measurement, shown in block 340. Thus, the start distance 180 plus distance 147 is the distance the conveyor 100 must travel after the reference point 165 is sensed before the applicator 130 begins application of the treatment to the target blank, and the end distance 185 plus distance 147 is the distance the conveyor must travel after the reference point 165 is sensed before the applicator 130 stops treatment of the target blank.

Block 230 is accomplished by the controller 122 storing the start distance 180 and the end distance 185 into a storage device (not shown). The controller 122 causes the applicator 130 to begin application of the treatment to the target blank at the start distance 180 plus distance 147, and to end application of the treatment at the end distance 185 plus the distance 147.

In a further embodiment, the control 122 compensates for sensor operational delays, such as sensor turn-on delay and sensor turn-off delay. Because the sensor turn-on delay is equal to the sensor turn-off delay, only the sensor turn-on delay need be compensated for. A sensor turn-on delay time is entered into the controller by the system operator, the sensor turn-on delay time representing delay of the sensor to indicate a sensed mark, determined using the manufacturer specifications. The controller 122 determines a conveyor speed using the conveyor encoder 140. A sensor turn-on distance is determined by multiplying the conveyor speed by the sensor turn-on delay time. The controller 122 compensates for the sensor turn-on delay and the sensor turn-off delay by adding the sensor turn-on distance to the distance 150 when determining the start distance 180 and the end distance 185.

The system could be used to set the applicator 130 to apply treatment to a plurality of marks (not shown) on example blank 105*a*, where a location for each of the plurality of marks is determined by the controller 122 in a manner similar to that discussed above, and the applicator 130 is programmed to apply the treatment to the target blank at each of the plurality of marks.

Further, a plurality of applicator assemblies 115 could be placed on the support bar 120 for sensing a plurality of marks spaced over the example blank in the direction 110, where each of the plurality of marks represents a desired location for treatment of the target blank. In this embodiment, the controller 122 is suitable to program the marks sensed by each of the plurality of applicator assemblies.

Having the system for setting up the applicator reduces the potential for error due to incorrect measurement by the operator, as the desired location for the treatment is sensed automatically, and the applicator is programmed automatically based on the sensing. Further, as the sensing and programming may occur at high conveyor speeds, the time required for programming the applicator is greatly reduced over that taken by the operator.

Figure 6:
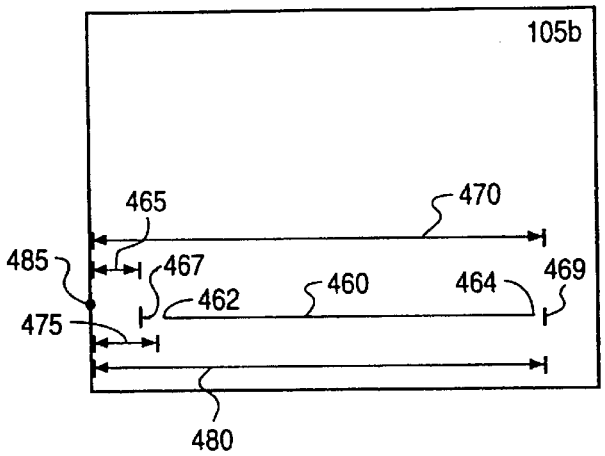
FIG. 6 is a plan view of the target blank.
Figure 7:
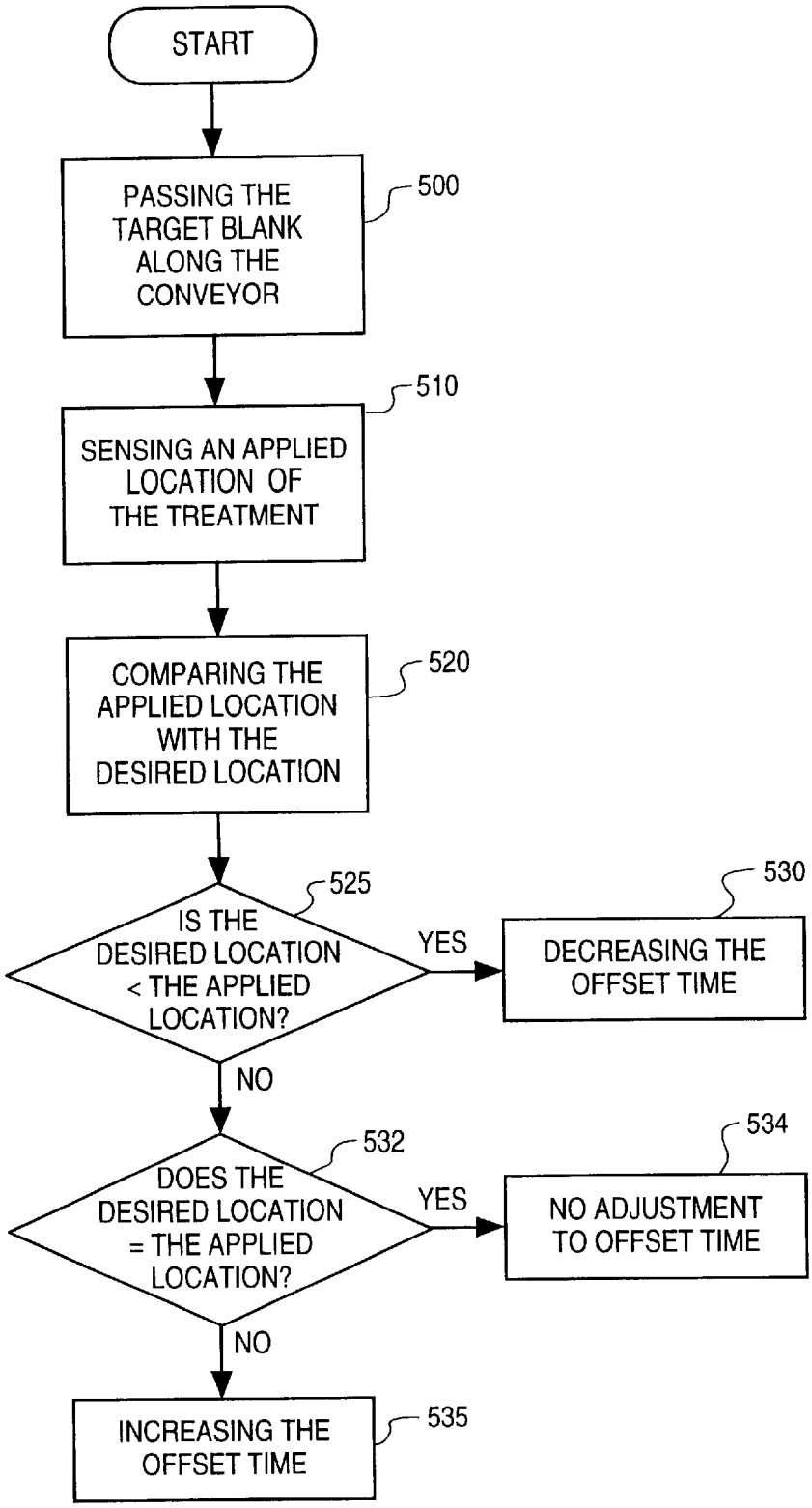
FIGS. 7–8 are flow charts illustrating operation of the system for regulating and monitoring the applicator.
Figure 8:
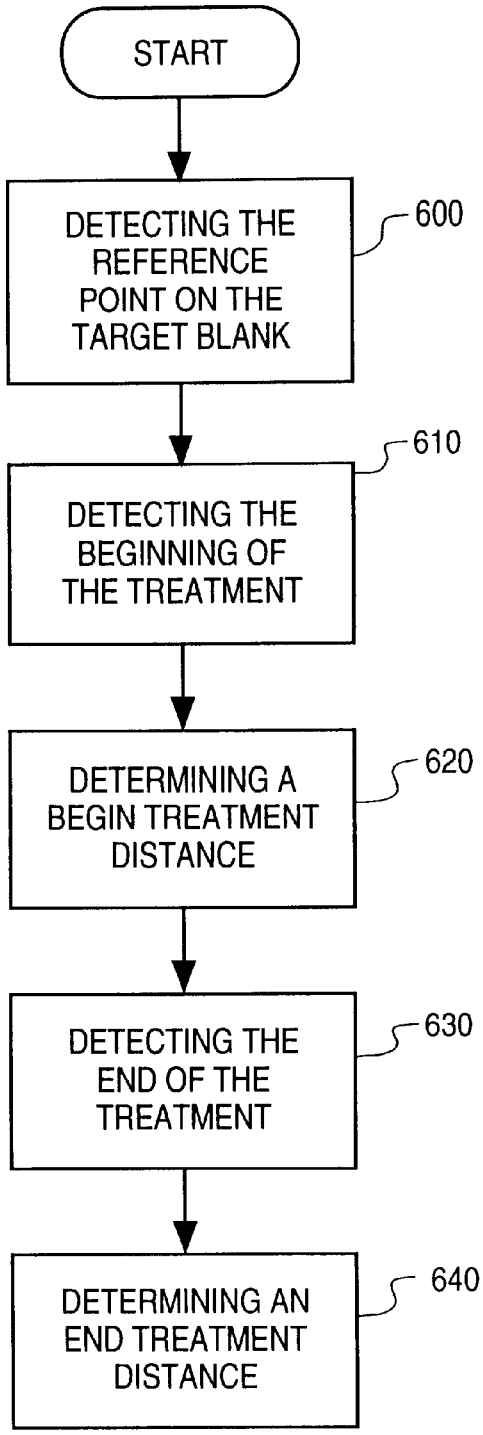

Operation of the system for regulating and monitoring an applicator to treat a target blank traveling on a conveyor is shown in FIGS. 7–8. Before discussing operation of the system for regulating and monitoring the applicator, a discussion of the target blank 105*b* (FIG. 6) will be helpful.

A plan view of the target blank 105*b* is shown in FIG. 6. The target blank 105*b* includes a reference point 485. A desired location for application of the treatment is defined by a desired start distance 465 between a desired start point 467 and the reference point 485, and a desired end distance 470 between a desired end point 469 and the reference point 485. The applied location 460 of the treatment is defined by a beginning 462 of the treatment and an end 464 of the treatment, the applied location 460 representing an actual location at which the applicator 130 applied the treatment to the target blank 105*b*. A begin treatment distance 475 is the distance between the beginning 462 of the treatment and the reference point 485. An end treatment distance 480 is the distance between the end 464 of the treatment and the reference point 485.

The controller 122 stores the desired start distance 465, the desired end distance 470, the distance 147, the distance 150, the begin treatment distance 475 and the end treatment distance 480 in the storage device. An offset start time is determined by taking the desired start distance 465, subtracting the begin treatment distance 475, and dividing the difference by a conveyor speed measured using the conveyor encoder 140. An offset end time is determined by taking the desired end distance 470 and subtracting the end treatment distance 480, where the difference is divided by the conveyor speed. The offset start time and the offset end time are stored into the storage device. The offset start time and offset end time represent delays of the applicator for beginning and ending treatment of the target blank and are initialized to zero each time the applicator is programmed to apply a treatment. Additionally, the controller 122 stores the sensor turn-on delay time in the storage device.

Once the applicator 130 has been programmed to apply the treatment to the target blank at the desired location, target blanks, such as the target blank 105*b* travel along the conveyor 100 and under the applicator 130 where the treatment is applied to the target blank. To apply the treatment, the reference sensor 125 senses the reference point 485 on the target blank 105*b*. The controller 122, using the conveyor encoder 140 and the storage device causes the applicator 130 to begin treatment after the target blank 105*b* has traveled the desired start distance 465 plus the distance 147 plus the offset start distance determined by multiplying the offset start time by the conveyor speed. The applicator 130 ends treatment of the target blank 105*b* after the target blank 105*b* has traveled the desired end distance 470, plus the distance 147 plus an offset end distance determined by multiplying the offset end time by the conveyor speed. However, due to operational delays or mechanical wear of components of the applicator 130, the applicator must be regulated to ensure that the applied location of the treatment coincides with the desired location. Operation of the system for regulating and monitoring the applicator is illustrated in the flow charts of FIGS. 7–8.

Target blanks, such as the target blank 105*b*, are passed along the conveyor 100, shown in block 500. As the target blanks are passed along the conveyor 100, the reference sensor 125 detects the reference point 485 on the target blank and the is applicator 130 applies the treatment as discussed above. The applied location 460 of the treatment is sensed as shown in block 510. A more detailed description of the sensing in block 510 is illustrated in the flow chart of FIG. 8.

Block 600–640 of FIG. 8 are performed in a manner similar to blocks 300–340 of FIG. 5, where the sensor 135 detects the beginning of the treatment 462 and the end of the treatment 464 in the same way that the beginning of the mark 170 and the end of the mark 175 are detected in blocks 310 and 330, and the controller 122 determines the begin treatment distance 475 and the end treatment distance 480 in the same manner as the start distance 180 and the end distance 185 are determined in blocks 320 and 340. Once determined, the begin treatment distance 475 and the end treatment distance 480 are stored in the storage device. The reference point is detected on the target blank by the reference sensor 125 as shown in block 600. In block 610, the beginning of the treatment 462 is detected by the sensor 135. The begin treatment distance 475 is determined by the controller 122, block 620. The end of the treatment 464 is detected using the sensor 135 as shown in block 630. In block 640, the end treatment distance 480 is determined by the controller 122.

Returning to FIG. 7, the applied location is compared with the desired location as shown in block 520. This block is performed by comparing the desired start distance 465 with the begin treatment distance 475, and comparing the desired end distance 470 with the end treatment distance 480. It is then determined by the controller 122 if the desired location is less than the applied location, as shown in block 525. To accomplish this, it is determined whether the desired start distance 465 is less than the begin treatment distance 475. If this is so, the applicator is adjusted to apply the treatment closer to the desired location by decreasing the offset start time, as shown in block 530. However, if the desired location is not less than the applied location in block 525, it is determined whether the desired location is equal to the applied location by determining if the desired start distance 465 is equal to the begin treatment distance 475 in block 532. If the start distance 465 is equal to the begin treatment distance 475, no adjustment of the offset start time is necessary as shown in block 534. However, if the desired start distance 465 is not equal to the begin treatment distance 475 in block 532, the applicator is adjusted to apply the treatment closer to the desired location by increasing the offset start time, as shown in block 535.

Further, block 525 is accomplished by determining whether the desired end distance 470 is less than the end treatment distance 480. If the desired end distance 470 is less than the end treatment distance 480, the applicator is adjusted to apply treatment closer to the desired location by decreasing the offset end time, as represented in block 530. If the desired end distance 470 is not less than the end treatment distance 480, it is determined whether the desired location equals the applied location by determining if the desired end distance 470 is equal to the end treatment distance 480, block 532. If the desired end distance 470 equals the end treatment distance 480, no adjustment of the offset end time is necessary as shown in block 534. If however, the desired end distance 470 is not equal to the end treatment distance 480 in block 532, the applicator is adjusted to apply treatment closer to the desired location by increasing the offset end time, as represented in block 535.

Block 530 is accomplished by determining a time required for the conveyor 100 to travel a fixed distance, for example, $1/10^{th}$ of an inch, and subtracting the time from the off-set start time or the offset end time, depending on whether the determining of block 525 is for the beginning treatment distance 475 or the end treatment distance 480. In a similar manner, block 535 is accomplished using the time for the conveyor 100 to travel the fixed distance, and adding the time to the offset start time or the offset end time, depending on whether the determining of block 525 is for the beginning treatment distance 475 or the end treatment distance 480.

The offset start time and the offset end time may be displayed on the display device 145 as applicator delays. Such information is useful to the system operator as offsets exceeding a predetermined value may represent a mechanical problem with the applicator resulting from component wear, necessitating replacement of applicator components. Such offsets may also indicate a problem with the treatment. For example, where the applicator is a glue applicator, offsets above the predetermined value may indicate wear of the glue applicator valve, or a problem with the glue being applied. Where the applicator is a cutting device, offsets above the predetermined value may indicate a dull applicator knife blade.

Further, when determining the begin treatment distance 475 and the end treatment distance 480, the controller 122 may compensate for sensor operational delay. The sensor turn-on distance is determined for each target blank in the manner described above, added to the distance 150, and stored in the storage device as a temporary distance 150. When determining the begin treatment distance 475 and the end treatment distance 480, the controller 122 uses the temporary distance 150 in place of the distance 150, thereby compensating for the sensor operational delay.

Further, a plurality of applicator assemblies 115 could be placed on the support bar 120 for sensing a plurality of applied location of treatment spaced over the target blank in the direction 110, where the controller 122 is suitable to adjust each of the plurality of applicators in the applicator assemblies.

Additionally, where the desired location includes a plurality of portions, separated by spaces where treatment is not be applied, the controller 122 adjusts the applicator 130 to apply treatment at the plurality of portions corresponding to the desired locations. To do this, the storage device stores desired start distances and desired end distances for each of the plurality of portions, and begin treatment distances and end treatment distances for each of a plurality of applied locations. The controller 122 adjusts the begin treatment distance for each of the portions according to the comparison of a desired start distance and a begin treatment distance for a first portion sensed by the sensor 135. The controller 122 adjusts the end treatment distance of applicator 130 for each of the portions according to the comparison of a desired end distance and an end treatment distance for a final portion of the target blank sensed by the sensor 135.

In an additional embodiment, the controller 122 adjusts the applicator 130 using offset start times and offset end times determined for an average of a predetermined number of previously treated target blanks, for example, five, where the controller stores offset start times and offset end times for a previous five treated blanks in the storage device. The controller 122 averages the offset start times and the offset end times over the five previous target blanks to adjust the applicator 130.

The example blank 105*a* may travel along the conveyor 100 at speeds of, for example, 2000 feet per minute.

The mark 160 is preferably made using a fluorescent marker, and the sensor 135 is an ultraviolet sensor. Alternatively, the mark 160 may be made using a marking device with a color different than that of the example blank, in which case the sensor 135 is a sensor suitable for detecting the mark on the example blank.

The reference point 165 of the blank 105*a* is typically a leading edge or a trailing edge of the blank 105*a*, and the reference sensor 125 is an edge sensor suitable for sensing the leading or trailing edge of the blank 105*a*. Alternatively, the reference point may be any point which may be sensed by the reference sensor 125.

The conveyor encoder 140 is a wheel in contact with the conveyor 100, where the wheel supplies pulses to the controller 122 used to measure conveyor movement, and thus distance. To obtain one pulse per $1/20^{th}$ inch of movement, the wheel could have a 12 inch circumference and provide 240 pulses per rotation.

The distances 147 and 150 are measured and entered in the controller by the operator, or in the case where a standardized applicator assembly is used, may be known by the controller in advance.

Where the applicator 130 is a glue applicator, a fluorescent material may be added to the glue, where the sensor 135 is an ultraviolet sensor suitable for sensing the fluorescent material in the glue.

The controller 122 is preferably a programmable processor as known in the art.

An example of regulating the applicator is shown in FIGS. 9A–F. The applicator 130 is programmed to apply a treatment at a desired location defined by a desired start distance 700 and a desired end distance 710. The offset start time and the offset end time are initialized to zero.

A first target blank passes under the applicator 130 where the treatment is applied (FIG. 9A) at the applied location 720*a*. The reference sensor 125 senses a reference point 750, in this case a leading edge of the target blank. Using the sensor is 135 and the conveyor encoder 140, the controller 122 determines the begin treatment distance 730*a* and the end treatment distance 740*a* as described in blocks 620 and 640, respectively. The begin treatment distance 730*a* and the end treatment distance 740*a* are stored into the storage device. The controller 122 compares the desired start distance 700 with the begin treatment distance 730*a*. In this case, the controller 122 determines that the desired start distance is less than the begin treatment distance 730*a*. The controller 122 determines the time required for the conveyor 100 to travel $1/10^{th}$ of an inch at the conveyor speed, and subtracts the time from the offset start time, storing the difference in the storage device. The controller 122 compares the desired end distance 710 with the end treatment distance 740*a*. The controller 122 determines that the desired end distance 710 is less than the end treatment distance 740*a*. The controller 122 adjusts the applicator to apply the treatment closer to the desired location by subtracting the time required for the conveyor 100 to travel $1/10^{th}$ of an inch from the offset end time stored in storage location 434, and storing the difference in the storage device. The reference sensor 125 senses the reference point of a second target blank traveling on the conveyor 100 (FIG. 9B), and the controller 122 causes applicator 130 to apply the treatment to the second target blank, as discussed above in reference to FIG. 6. Operation continues as described for FIG. 9A, where the begin treatment distance 730*b* and the end treatment distance 740*b* are stored into the storage device. Operation of FIGS. 9C and 9D are accomplished in a similar manner as FIGS. 9A–9B.

Figure 9:
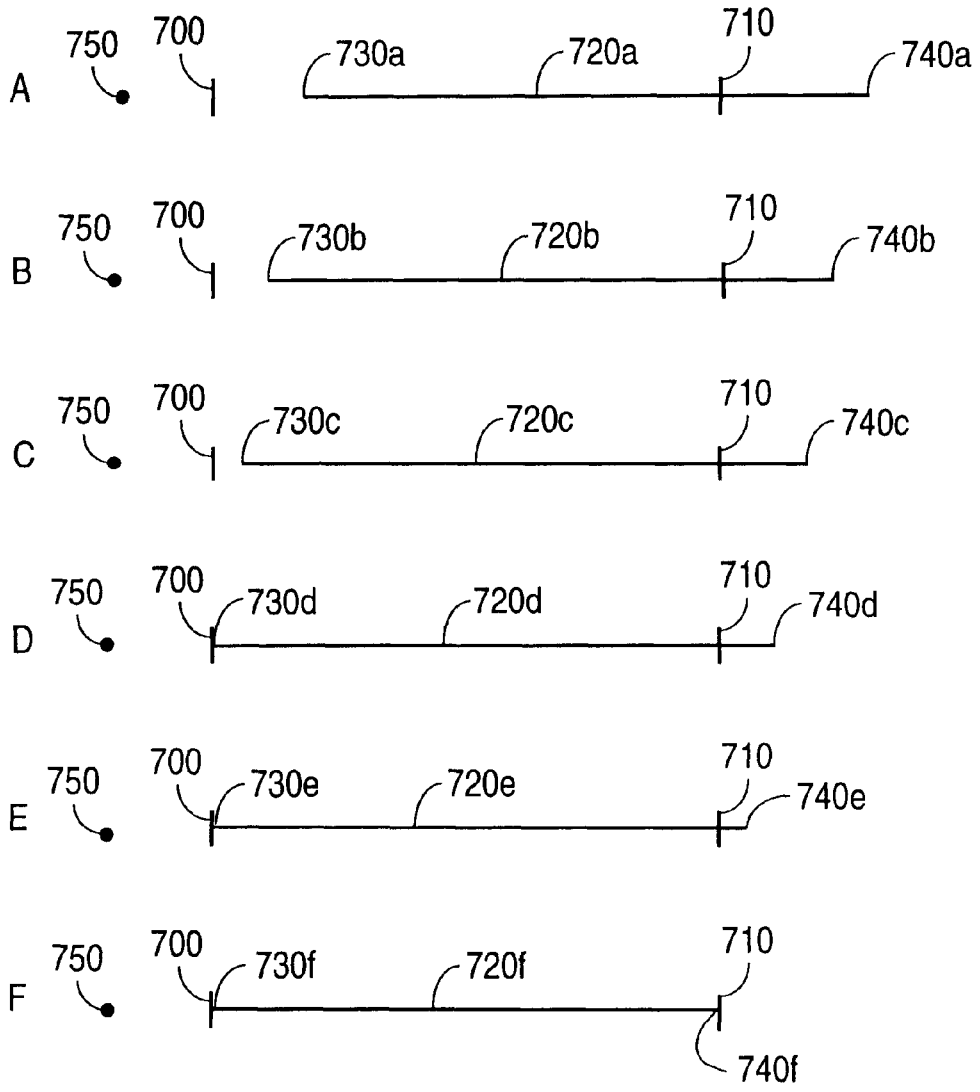
FIG. 9 is a chart illustrating adjustment of the applicator timing.

The controller 122 determines that the desired start distance 700 is not less than the begin treatment distance 730D in FIG. 9D, and does not adjust the offset start time. However, because the desired end distance 710 is less than the end treatment distance 740*d*, the offset end time will be adjusted in the manner discussed above in relation to FIGS. 9A–C. Operation of the system for the fifth target blank of FIG. 9E and the sixth target blank of FIG. 9F is accomplished in the same manner as for the fourth target blank of FIG. 9D.

Thus, after six blanks have passed, the controller 122 has adjusted the applicator 130 to apply the treatment at the desired location. As mechanical components of the applicator 130 wear, the controller 122 will compensate, adjusting the applicator 130 to continue to apply the treatment at the desired location.

In a further embodiment, where the applicator 130 is a blade for applying a cut to a blank traveling on the conveyor, the sensor 135 is located below the conveyor 100, and is set to sense across a plane parallel to, but below, the conveyor 100. The applied location of the cut is determined by sensing the blade breaching the plane sensed by the sensor 135. Thus, the controller 122 determines the begin treatment distance using the distance traveled by the conveyor 100 when the blade is first sensed by the sensor 135, and determines the end treatment distance by sensing the distance traveled by conveyor 100 when the blade is no longer sensed by the sensor 135.

Having the system for regulating and monitoring the applicator improves productivity of the conveyor system with the applicator as the applicator automatically compensates for operational delays and wear of mechanical components, thereby preventing down time resulting from an operator manually regulating the system, and further reduces waste resulting from improper application of the treatment by the applicator. Additionally, as applicator delays are automatically determined and displayed, the system operator is able to more accurately monitor the applicator for worn applicator components, preventing premature replacement of a component.

As will be appreciated by one of ordinary skill in the art, the system may be embodied as methods or devices. Accordingly, the system for programming the applicator and the system for regulating the applicator may take the form of an entirely hardware embodiment, an entirely software embodiment, or an embodiment combining hardware and software aspects.

While a particular embodiment of the invention has been described and illustrated, it should be understood that the invention is not limited thereto since modifications may be made by persons skilled in the art. The present application contemplates any and all modifications that fall within the spirit and scope of the underlying invention disclosed and claimed herein.

We claim:

1. A method for setting up an applicator to treat a target blank traveling on a conveyor, the method comprising:

placing a mark on an example blank, the mark representing a desired location for treatment of the target blank;

passing the marked example blank along the conveyor;

sensing the location of the mark on the example blank; and programming the applicator to treat the target blank at the sensed location without an advance location input by an operator regarding the desired location on the target blank.

2. The method of claim 1 wherein the example blank has a reference point, the mark is defined by a beginning of the mark, and the step of sensing the location of the mark includes:

detecting the reference point on the example blank traveling along the conveyor;

detecting the beginning of the mark on the example blank; and determining a start distance between the reference point and the beginning of the mark; and the step of programming the applicator includes setting the applicator to begin treatment of the target blank at the start distance.

3. The method of claim 1 wherein the example blank has a reference point, the mark is defined by an end of the mark, and the step of determining the location of the mark includes:

detecting the reference point on the example blank traveling along the conveyor;

detecting the end of the mark on the example blank; and determining an end distance between the reference point and the end of the mark; and the step of programming the applicator includes setting the applicator to stop treatment of the target blank at the end distance.

4. The method of claim 1 wherein the mark is a first mark and the location is a first location, and further including the steps of:

placing a plurality of marks on the example blank;

sensing a plurality of locations for the plurality of marks on the example blank; and programming the applicator to treat the target blank at the sensed plurality of locations.

5. The method of claim 1 wherein the applicator applies a substance on the target blank at the sensed location.

6. A method for regulating an applicator for linearly treating a desired location of a target blank traveling along a conveyor, the method comprising:

passing the target blank along the conveyor;

applying a linear treatment to the target blank;

reflectively sensing an applied location of the linear treatment to the target blank;

comparing the applied location with the desired location; and adjusting the applicator to apply the linear treatment at the desired location.

7. The method of claim 6 wherein the applied location is defined by a beginning of the treatment, the desired location is defined by a desired start distance and the target blank has a reference point, and the step of sensing the applied location includes:

detecting the reference point on the target blank traveling along the conveyor;

detecting the beginning of the treatment on the target blank; and determining a begin treatment distance between the reference point and the beginning of the target; and the step of adjusting the applicator includes decreasing the begin treatment distance if the desired start distance is less than the begin treatment distance, an increasing the begin treatment distance if the begin treatment distance is less than the desired start distance.

8. The method of claim 6 wherein the applied location is defined by an end of the treatment, the desired location is defined by a desired end distance and the target blank has a reference point, and the step of sensing the applied location includes:

detecting the reference point on the target blank traveling along the conveyor;

detecting the end of the treatment on the target blank; and determining an end treatment distance between the reference point and the end of the treatment; and the step of adjusting the applicator includes decreasing the end treatment distance if the desired end distance is less than the end treatment distance, and increasing the end treatment distance if the end treatment distance is less than the desired end distance.

9. The method of claim 6 wherein the desired location is a first desired location of a plurality of desired locations, and the applied location is a first applied location of a plurality of applied locations to the target blank, and further including the steps of:

reflectively sensing the plurality of applied locations of the treatment to the target blank; and responsive to the sensing, adjusting the applicator to apply the treatment at the plurality of applied locations at the plurality of desired locations.

10. The method of claim 6 further comprising the steps of:

sensing a conveyor speed;

responsive to the sensing, determining a distance between the applied location and the desired location;

determining a delay between when the applicator is directed to apply the treatment and when the treatment is actually applied using the distance and the conveying speed; and displaying the delay.

11. The method of claim 6 further comprising the steps of:

determining the applied locations of treatment for a plurality of target blanks; and determining an average applied location of treatment;

wherein the step of comparing compares the average applied location with the desired location.

12. The method of claim 6 wherein the applicator includes a sensor having a sensor delay and adjusting the applicator includes compensating for the sensor delay.

13. A system for regulating an applicator to linearly treat a desired location of a target blank traveling along a conveyor, the system comprising:

a sensor in proximity to the target blank for reflectively sensing an applied location of the linear treatment on the target blank; and a controller responsive to the sensor for comparing the applied location with the desired location, and adjusting the applicator to apply the linear treatment at the desired location.

14. The system of claim 13 wherein the target blank has a reference point, the desired location is defined by a desired start distance and the sensor determines a beginning of the treatment, and further including:

a reference sensor coupled to the adjustor for detecting the reference point; and a conveyor encoder responsive to conveyor movement for measuring distance, and coupled to the controller;

wherein the controller determines a begin treatment distance between the reference point and the beginning of the treatment, and adjusts the applicator to decrease the begin treatment distance if the desired start distance is less than the begin treatment distance, and adjusts the applicator to increase the begin treatment distance if the begin treatment distance is less than the desired start distance.

15. The system of claim 14 wherein the reference point is a leading edge of the target blank and the reference sensor is an edge sensor.

16. The system of claim 13 wherein the applicator is a glue applicator for applying glue to the target blank, the glue having a flourescent material added thereto, and the sensor is an ultraviolet sensor.

17. The system of claim 13 wherein the controller determines a delay between when the applicator is directed to apply the treatment and when the treatment is actually applied, and further including a display device for displaying the delay.

18. The system of claim 13 wherein the applicator is a cutting device for applying a cut to the target blank.

19. A method for determining a delay of an applicator for linearly treating a desired location of a target blank traveling along a conveyor, the method comprising:

passing the target blank along the conveyor;

applying a linear treatment to the target blank;

reflectively sensing an applied location of the linear treatment to the target blank; and determining a distance between the applied location and the desired location indicative of the applicator delay.

20. The method of claim 19 further comprising:

sensing a conveyor speed; and dividing the distance by the conveyor speed, indicating an applicator delay time.

21. The method of claim 19 further comprising displaying the distance.

22. A system for determining a delay of an applicator for linearly treating a desired location of a target blank traveling along a conveyor, the system comprising:

a sensor in proximity to the target blank for reflectively sensing an applied location of the linear treatment on the target blank; and a controller responsive to the sensor for determining a differential difference between the applied location and the desired location indicative of the applicator delay.

23. The system of claim 22 further comprising a conveyor encoder coupled to the controller and responsive to conveyor movement for measuring distance, wherein the controller determines a conveyor speed using the conveyor encoder, and divides the distance by the conveyor speed, indicating an applicator delay time.

24. The system of claim 22 further comprising a display device for displaying the distance.

25. A system for setting up an applicator to treat a target blank traveling on a conveyor using an example blank, the example blank having a mark representing a desired location for treatment of the target blank and a reference point, the system comprising:

a sensor for sensing the mark on the example blank to detect a beginning of the mark and an end of the mark;

a reference sensor for detecting the reference point;

a conveyor encoder responsive to conveyor movement for measuring distance; and a controller responsive to said sensor, said reference sensor and said conveyor encoder to determine the location of the mark using a start distance between the reference point and the beginning of the mark and an end distance between the reference point and the end of the mark and controlling the applicator to treat the target blank, beginning the treatment at the start distance and stopping the treatment at the end distance.

26. The system of claim 25 wherein the reference point is a leading edge of the example blank and the reference sensor is an edge sensor.

* * * * *